US008127741B2

(12) United States Patent
Johng et al.

(10) Patent No.: US 8,127,741 B2
(45) Date of Patent: Mar. 6, 2012

(54) IGNITION PLUGS FOR INTERNAL COMBUSTION ENGINE

(75) Inventors: In Tae Johng, Seoul (KR); Myung Seok Jie, Seoul (KR)

(73) Assignee: In Tae Johng, Seokgwan-Dong, Seongbuk-Gu, Seoul (KR)

( * ) Notice: Subject to any disclaimer, the term of this patent is extended or adjusted under 35 U.S.C. 154(b) by 0 days.

(21) Appl. No.: 10/558,652

(22) PCT Filed: Jun. 9, 2003

(86) PCT No.: PCT/KR03/01126

§ 371 (c)(1),
(2), (4) Date: Nov. 6, 2006

(87) PCT Pub. No.: WO2004/107518

PCT Pub. Date: Dec. 9, 2004

(65) Prior Publication Data

US 2007/0119409 A1 May 31, 2007

(30) Foreign Application Priority Data

May 30, 2003 (KR) ..... 10-2003-0034812

(51) Int. Cl.
*F02B 19/00* (2006.01)

(52) U.S. Cl. ... 123/250; 123/261; 123/273; 123/169 EA

(58) Field of Classification Search ..... 123/267, 123/169, 250, 253, 261, 266, 273, 169 EA, 123/169 R; 313/123
See application file for complete search history.

(56) References Cited

U.S. PATENT DOCUMENTS

| | | | | | |
|---|---|---|---|---|---|
| 3,926,169 | A | * | 12/1975 | Leshner et al. | 123/297 |
| 4,006,725 | A | * | 2/1977 | Baczek et al. | 123/267 |
| 4,071,001 | A | * | 1/1978 | Goto | 123/260 |
| 4,072,134 | A | * | 2/1978 | Noguchi et al. | 123/260 |
| RE29,978 | E | * | 5/1979 | Leshner et al. | 123/297 |
| 4,892,070 | A | * | 1/1990 | Kuhnert | 123/274 |
| 5,224,449 | A | * | 7/1993 | Fukano et al. | 123/267 |
| 5,947,076 | A | * | 9/1999 | Srinivasan et al. | 123/267 |
| 2005/0268882 | A1 | * | 12/2005 | Robinet et al. | 123/254 |

OTHER PUBLICATIONS

Myoung Seok Jie et al., The Effect of Tumble Flow on Engine Performance and Flame Propagation, SAE Technical Paper Series, Phoenix, Arizona, Nov. 15-19, 1993, pp. 1-13.
John B. Heywood, Internal Combustion Engine Fundamentals, 1989, McGraw-Hill International Editions, pp. 567-572.

* cited by examiner

*Primary Examiner* — John Kwon
(74) *Attorney, Agent, or Firm* — Lexyoume IP Group, PLLC

(57) ABSTRACT

An ignition plug for an internal combustion engine is provided, which includes a pre-combustion chamber cell (150) and at least three exhaust nozzles (160, 170). The pre-combustion chamber cell (150) is disposed to surround a pair of electrodes (140*b*) in the lower portion of a main cell (110) and is formed in the inner portion where the electrodes (140) are contained. Meanwhile, a circular main exhaust nozzle (160) through which a fluid goes in and out is disposed in the central region of the pre-combustion chamber cell (150). The ignition plug enables the whole engine to have a quick combustion speed. As a result, a more reliable improvement of a combustion performance can be obtained. Also, a fuel-to-air ratio can be enhanced, and an exhaust gas reduction effect can be obtained.

10 Claims, 8 Drawing Sheets

IGNITION PLUGS FOR INTERNAL COMBUSTION ENGINE

This application is a 35 U.S.C. §371 national phase entry of International Application No. PCT/KR2003/001126, which claims priority from Korean Patent Application No. 10-2003-0034812, filed on May 30, 2003, the contents of which are herein incorporated by reference in their entirety.

TECHNICAL FIELD

The present invention relates to an ignition plug for an internal combustion engine, and more particularly, to an ignition plug for an internal combustion engine that enables the whole engine to have a quick combustion speed, with a result that a more reliable improvement of a combustion performance can be obtained, a fuel-to-air ratio can be enhanced, and an exhaust gas reduction effect can be also obtained at the engine, although the whole engine is ignited in retard and short at an angle from 5° to 15° or so, on a crankshaft, at a low speed.

BACKGROUND ART

In general, a thermal engine is an apparatus that converts a thermal energy into a mechanical work. The thermal engine is largely classified into an internal combustion engine and an external combustion engine, according to a method of supplying a thermal energy to a working material such as a fluid which is used for converting a thermal energy into a mechanical work.

In the case of the internal combustion engine, combustion is performed in the inner portion of the engine. Here, a chemical energy possessed in the fuel-air mixture that is a mixture of a fuel such as gasoline with the clean air, is converted into a thermal energy by the combustion. Then, the internal combustion engine directly uses an expansion force generated by expansion of the combustion gas.

The internal combustion engine is largely classified into a four-stroke cycle engine and a two-stroke cycle engine according to an operational method. In the four-stroke cycle engine, one cycle of intake, compression, power and exhaust strokes is accomplished by two rotations of a crankshaft, that is, four stokes of a piston.

An example of the four-stroke engine is schematically shown in FIG. 1A. As shown, an electrical ignition type internal combustion engine 10 includes a cylindrical cylinder 11, a piston 12 accommodated in the hollow of the cylinder 11 air-tightly, a crankshaft 14 connected to the lower end of the piston 12 by a connecting rod 13, intake and exhaust valves 16 and 15 mounted in the upper portion of the cylinder 11, and an ignition plug 100. Intake and exhaust openings 18 and 17 are formed in the upper portion of the cylinder 11.

When the internal combustion engine 10 is a four-stroke cycle engine, the engine 10 is driven by an operational mechanism composed of intake, compression, power and exhaust strokes, respectively, as shown in FIG. 1A, to thereby generate power.

Here, in the case of the intake stroke, the piston 12 descends from a TDC (Top Dead Center), that is, the top of the piston 12 at the state where an intake valve 16 opens an intake opening 18, to thereby inhale a fuel-air mixture into the cylinder 11.

In the case of the compression stroke, the piston 12 ascends to compress the fuel-air mixture at the state where the intake and exhaust openings 18 and 17 are closed. Thus, the pressure and temperature of the fuel-air mixture rise up simultaneously so that the fuel-air mixture is completely evaporated.

Also, in the case of the power stroke, the ignition plug 100 ignites the fuel-air mixture by spark, at an angle from 5° to 45° or so, on a crankshaft, before the TDC where the compression stroke ends, to thereby perform a combustion of the fuel-air mixture. In this case, the piston 12 descends by the generated high-pressure gas to resultantly give rise to a torque to the crankshaft 14.

Also, in the case of the exhaust stroke, the piston 12 ascends at the state where the exhaust valve 15 opens the exhaust opening 17, to thereby exhaust the combustion gas out of the cylinder 11. When the piston 12 reaches the TDC, another cycle is repeated again from the intake stroke.

Here, ignition spark plugs are used to fire and burn the fuel-air mixture with an electric spark at the compression and power strokes in the electrical igniting type internal combustion engine.

A conventional ignition plug for an internal combustion engine is disclosed in Korean Patent No. 328490. As is illustrated in FIG. 1B, part of the compressed fuel-air mixture is primarily fired and burnt at the time of igniting of the electric igniting type internal combustion engine, and then small-scale explosive flames generated from the primary firing and burning are discharged into a combustion chamber. Accordingly, a main fuel-air mixture in the combustion chamber is fired more quickly and reliably, and burnt within a relatively much shorter time. As a result, the whole burning time of the fuel-air mixture on the crankshaft angle can be shortened at maximum.

This type of the ignition plug has a single circular exhaust nozzle through which a fluid goes in and out. However, in comparison with the existing ignition plug, the burning time of the engine can be shortened but small-scale explosive flames may be transferred to the combustion chamber.

Thus, a communicating space in the exhaust nozzle should be improved in a manner that a combustion gas in the whole combustion chamber is burnt or exploded more quickly around the TDC on the engine crankshaft angle during a power stroke to thereby improve combustion efficiency.

DISCLOSURE OF THE INVENTION

To solve the above problems including the limitation of the conventional ignition plug, it is an object of the present invention to provide an ignition plug for an internal combustion engine that enables the whole engine to perform a quick combustion to the end of a combustion chamber, with a result that a more reliable improvement of a combustion performance can be obtained, a combustion efficiency can be enhanced, a fuel-to-air ratio can be enhanced, and an exhaust gas reduction effect can be also obtained, although the whole engine is ignited in retard and short at an angle from 5° or so at a low speed to 15° or so at a high speed, on a crankshaft.

It is another object of the present invention to provide an ignition plug for an internal combustion engine that can enhance a combustion performance efficiency to heighten a sparse fuel-to-air ratio a little more, to thus reduce an exhaust of carbon dioxide, and can raise an engine compression rate from a 1/10 ratio to a 1/11 ratio to thus realize a superior engine efficiency.

It is still another object of the present invention to provide an ignition plug for an internal combustion engine that solves defectives of a conventional ignition plug that is due to causing explosive flames in a pre-combustion chamber cell to be transferred to a combustion chamber, to thus make the explosive flames in the pre-combustion chamber cell spread and sprayed into a combustion chamber more quickly and then enable the whole engine to perform a quick combustion to the end of the combustion chamber.

To accomplish the above object of the present invention, there is provided an ignition plug for an internal combustion engine, the ignition plug comprising: a hollow main cell; a pair of electrodes that are provided at the lower portions of the closest positions that are not obstructed except for spraying of the main cell; and a pre-combustion chamber cell that is disposed to surround the pair of electrodes in the lower portions of the main cell, to thereby form a pre-combustion chamber in the inner portion where the electrodes are accommodated, and also form at least three exhaust nozzles or more.

Preferably, the pre-combustion chamber cell is of 16 mm or less in diameter, and 6 mm or less in height.

Preferably, the at least three exhaust nozzles formed in the pre-combustion chamber cell are formed of a main exhaust nozzle located at the center of the pre-combustion chamber cell and auxiliary exhaust nozzles disposed with a predetermined interval along the outer circumferential direction from the radial direction of the main exhaust nozzle.

In the case that the ignition plug for an internal combustion engine according to the present invention is applied to a single overhead camshaft (SOHC) driving system, three auxiliary exhaust nozzles can be only installed without having a main exhaust nozzle. In this case, it is preferable that each auxiliary exhaust nozzle is of 1.0Φ to 1.5Φ in diameter and is disposed distant by an interval of 120° from the adjacent auxiliary exhaust nozzle. In the case that a main exhaust nozzle exists in the SOHC engine, it is preferable that the main exhaust nozzle is of 1.2Φ to 1.4Φ in diameter, and three auxiliary exhaust nozzles are of 1.0Φ to 1.2Φ in diameter, respectively and are disposed with an interval of 120° at the outer side of the main exhaust nozzle.

In the case that the ignition plug for an internal combustion engine according to the present invention is applied to a double overhead camshaft (DOHC) driving system, only auxiliary exhaust nozzles can be installed without having a main exhaust nozzle. In this case, it is preferable that each auxiliary exhaust nozzle is of 1.0Φ to 1.5Φ in diameter and is disposed distant by an interval of 90° from the adjacent auxiliary exhaust nozzle. In the case that a main exhaust nozzle exists in the DOHC driving system, it is preferable that the main exhaust nozzle is of 1.2Φ to 1.4Φ in diameter, and four auxiliary exhaust nozzles are of 0.8Φ to 1.5Φ in diameter, respectively and are disposed with an interval of 90° at the outer side of the main exhaust nozzle.

The pre-combustion chamber cell in the internal combustion engine according to the present invention can be made of one of various shapes such as a hemisphere, rectangle, U-shape, and trapezoid.

BRIEF DESCRIPTION OF THE DRAWINGS

The above and other objects and advantages of the present invention will become more apparent by describing the preferred embodiments thereof in more detail with reference to the accompanying drawings in which.

BEST MODE FOR CARRYING OUT THE INVENTION

Figure 1A:
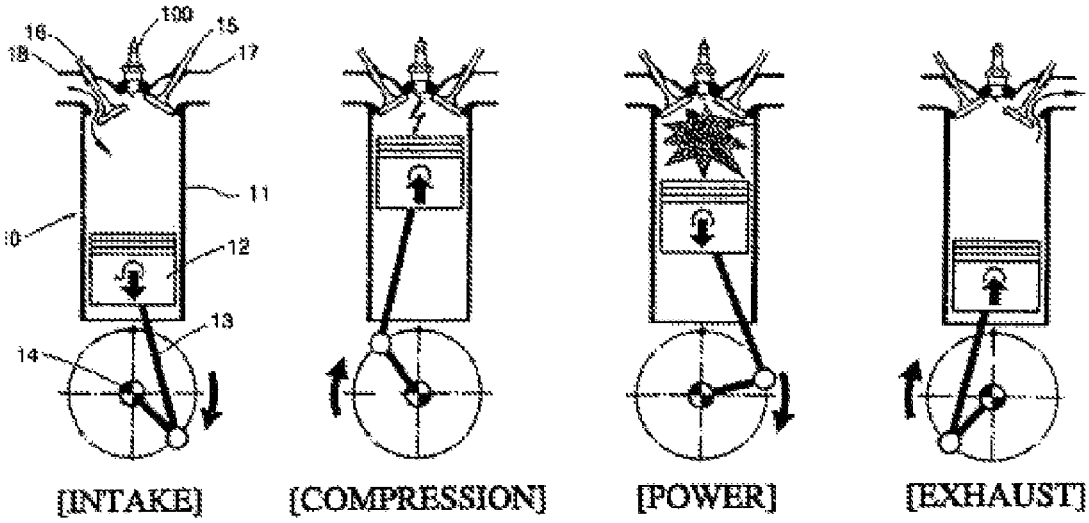
FIG. 1A Prior Art
FIG. 1A shows an operational mechanism of an electrical igniting internal combustion engine such as a four-stroke cycle engine where conventional ignition plugs are installed.

A preferred embodiment of the present invention will be described in detail with reference to the accompanying drawings. The same elements as those of FIG. 1A are assigned with the same reference numerals as those of FIG. 1A.

Figure 2:
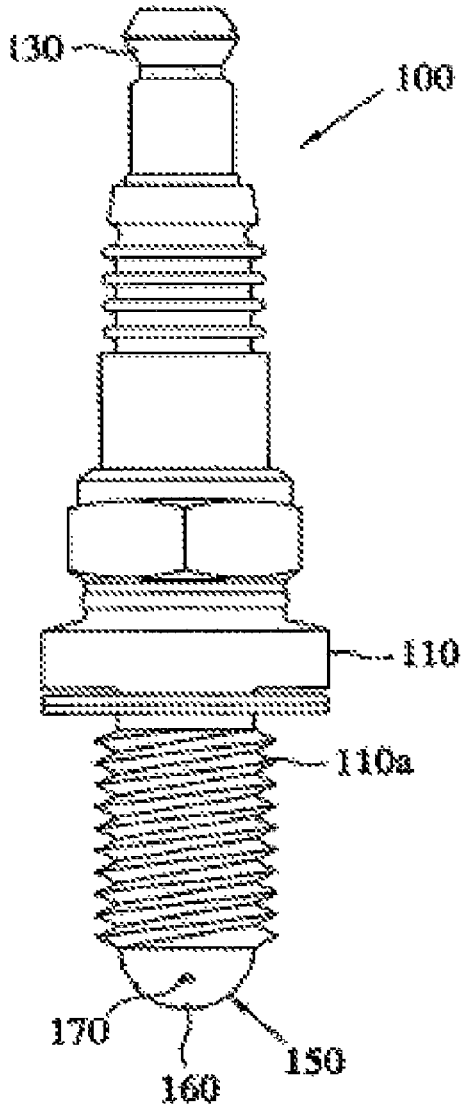
FIG. 2 is a front view of an ignition plug for an internal combustion engine according to a first embodiment of the present invention.
Figure 3:
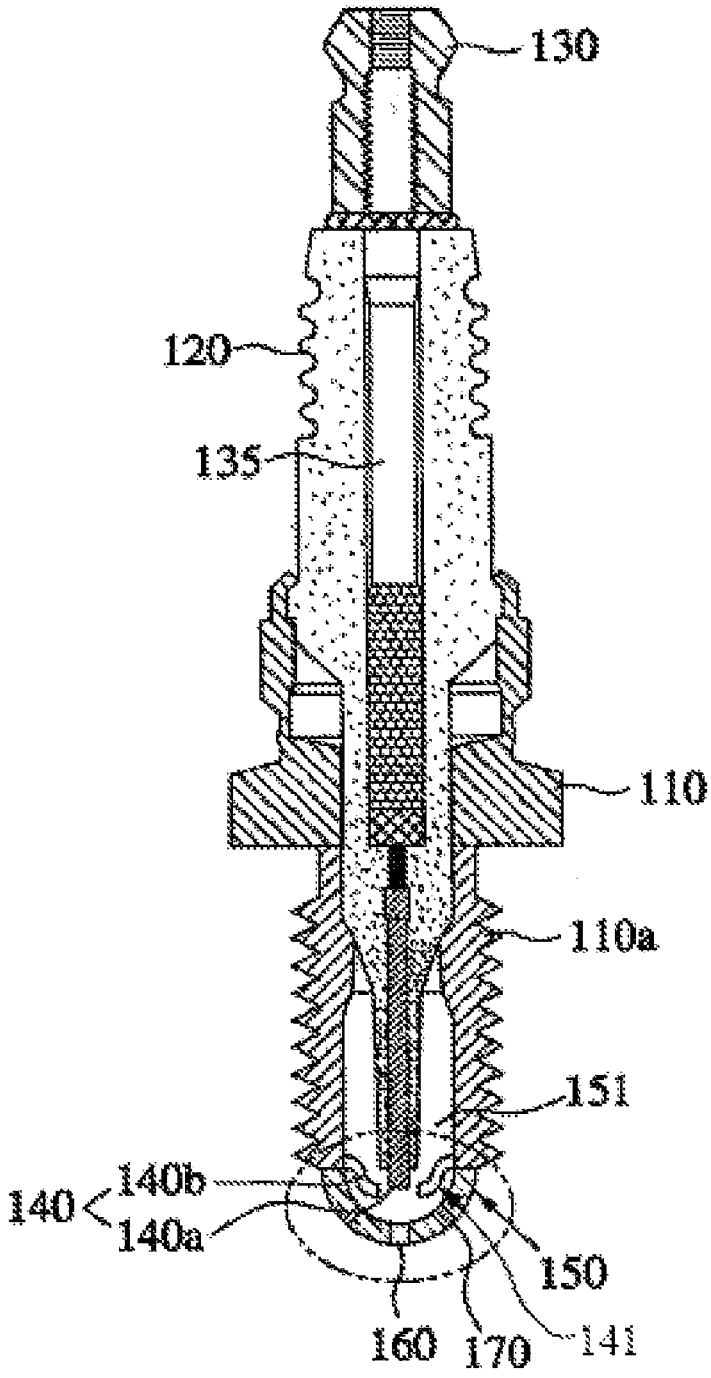
FIG. 3 is a cross-sectional view of FIG. 2.

FIG. 2 is a front view of an ignition plug for an internal combustion engine according to a first embodiment of the present invention. FIG. 3 is a cross-sectional view of FIG. 2.

As illustrated in FIGS. 2 and 3, the ignition plug 100 for an internal combustion engine according to a first embodiment of the present invention includes a hollow main cell 110; electrodes 140 that are provided at the lower portion of the main cell 110, and forms a respectively different polarity by a power supply; and an insulator 120 mounted in the hollow of the main cell 110. The insulator 120 is installed in the hollow of the main cell 110 at the state where a central electrode 140*a* among the electrodes 140 is sheathed with an insulation material. An axial rod 135 connected to the upper terminal 130 and the electrode 140 is integrally sheathed by the insulator 120.

A screw thread 110*a* is formed on the lower outer side of the main cell 110. The electrodes 140 include a central electrode 140*a* disposed in the central area and a pair of ground electrodes 140*b* formed in either side of the central electrode 140*a* in correspondence to each other.

The central electrode 140*a* is formed of a linear shape along the vertical direction, while the pair of ground electrodes 140*b* have a partial circular arc shape that forms a rounded stepwise S-shape, as indicated by reference numeral 141 in FIG. 3. The end of each ground electrode 140*b* is disposed adjacent the central electrode 140*a*. Since the ground electrodes 140*b* are formed in the lower portions of the hollow of the main cell 110, they are cooled earlier and easily, to thereby perform electrification with respect to the central electrode 140*a* more effectively.

Meanwhile, the ignition plug for an internal combustion engine according to the present invention includes a hemispherical pre-combustion chamber cell 150 that is provided in the lower portion of the main cell 110. The electrodes 140 are surrounded by the hemispherical pre-combustion chamber cell 150.

The pre-combustion chamber cell 150 has a pre-combustion chamber 151 in the whole inner space that accommodates the electrodes 140. In the substantial central area of the lower portion of the pre-combustion chamber cell 150 and its peripheral portion are formed a circular main exhaust nozzle 160 and auxiliary exhaust nozzles 170 of a predetermined diameter through which a fluid can go in and out. The main exhaust nozzle 160 and the auxiliary exhaust nozzles 170 are disposed at a predetermined angle while having a predetermined diameter and height, respectively.

The pre-combustion chamber cell 150 is made of a heat resistant and oxidation preventive steel material. The pre-combustion chamber cell 150 protrudes by 3 mm to 7 mm in depth downwards from the lower portion of the main cell 110. The width of the pre-combustion chamber cell 150 ranges from 14 mm to 17 mm. It is most preferable that the width thereof is 16 mm. Considering the inner space volume of the pre-combustion chamber cell 150, it is most preferable that the pre-combustion chamber cell 150 is 16 mm in width and 6 mm in depth. The thickness of the pre-combustion chamber cell 150 is of 1 mm to 2 mm, but it is most preferable that the thickness thereof is 1.2 mm. The thickness t of the pre-combustion chamber cell is indicated in the example embodiments illustrated in FIGS. 5A, 5B and 5C.

The reason of limiting the downward protruding length of the pre-combustion chamber cell 150 is to prevent the ignition plug 100 mounted in the internal combustion engine from contacting or colliding with the piston 12 of FIG. 1A that is positioned in the lower portion of the ignition plug 100 and reciprocates up and down.

The pre-combustion chamber cell 150 can be integrally formed with the main cell 110 by extending the lower circumferential portion of the main cell 110 in the form of a hemisphere. Also, the pre-combustion chamber cell 150 is separately fabricated from the main cell 110 and then combined with the main cell 110, so as to be assembled and disassembled with and from the main cell 110, respectively. However, when the pre-combustion chamber cell 150 is separately fabricated from the main cell 110 and then combined with the main cell 110, air tightness and assembly reliability with respect to the main cell 110 should be assumed taking the high pressure in the combustion chamber into consideration.

Figure 6A:
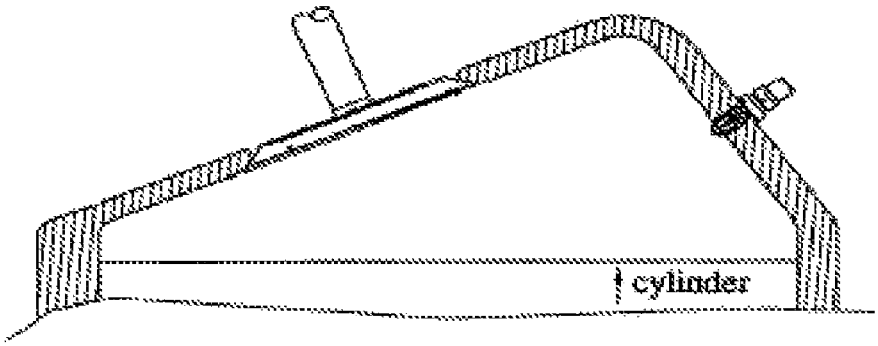
FIGS. 6A and 6B are sectional views showing examples of a single overhead camshaft (SOHC) engine and a double overhead camshaft (DOHC) engine in which a pre-combustion chamber cell according to the present invention is respectively applied.

In the case of a SOHC engine as shown in FIG. 6A, it is preferable that three exhaust nozzles are disposed in the pre-combustion chamber cell 150, with an interval of 120° around the origin of the pre-combustion chamber cell 150.

Figure 6B:
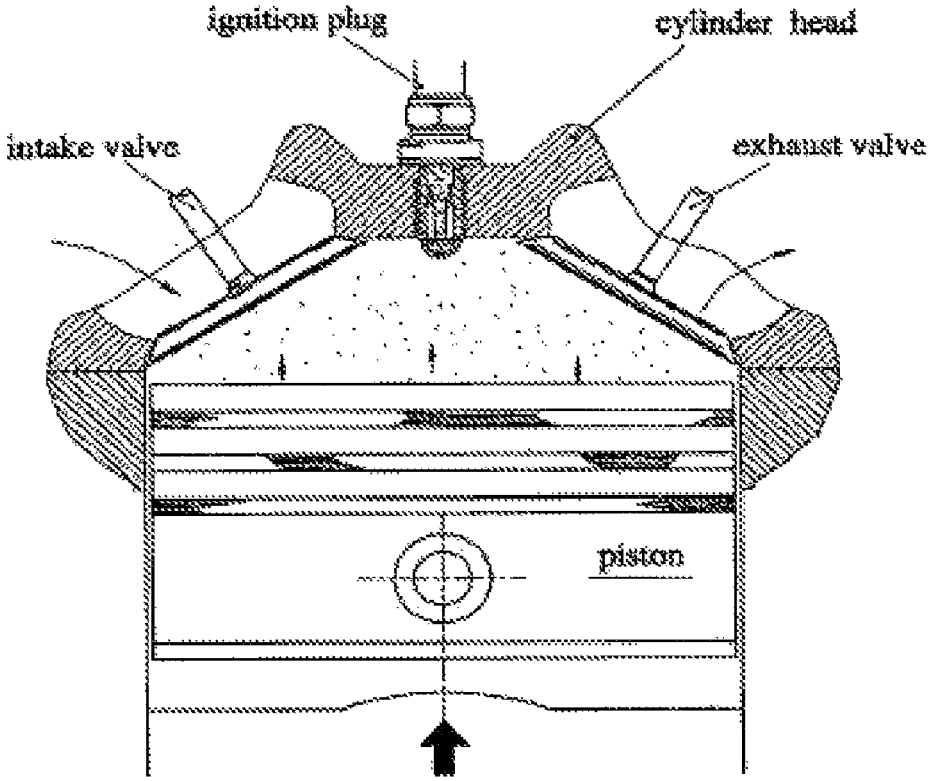

In the case of a DOHC engine as shown in FIG. 6B, it is preferable that a main exhaust nozzle 160 is disposed on the central portion of the pre-combustion chamber cell 150 and at least three exhaust nozzles are disposed in the outer portion of the main exhaust nozzle 160, with an interval of 120° around the origin of the pre-combustion chamber cell 150.

The main exhaust nozzle 160 formed in the pre-combustion chamber cell 150 can be varied in size according to the volume of each combustion chamber in the internal combustion engine in which the ignition plug 100 is applied. For example, in the case that the volume of the combustion chamber is 250 cc to 450 cc, the main exhaust nozzle 160 can range from 3.4 mm to 4 mm in diameter. In the case that the volume of the combustion chamber is 450 cc to 500 cc, the main exhaust nozzle 160 can range from 3.8 mm to 4.6 mm in diameter. However, in this embodiment, it is assumed that the diameter of the main exhaust nozzle 160 ranges from 1Φ to 1.2Φ at minimum and from 1.4Φ to 1.6Φ at maximum, non-dimensionally.

Figure 5A:
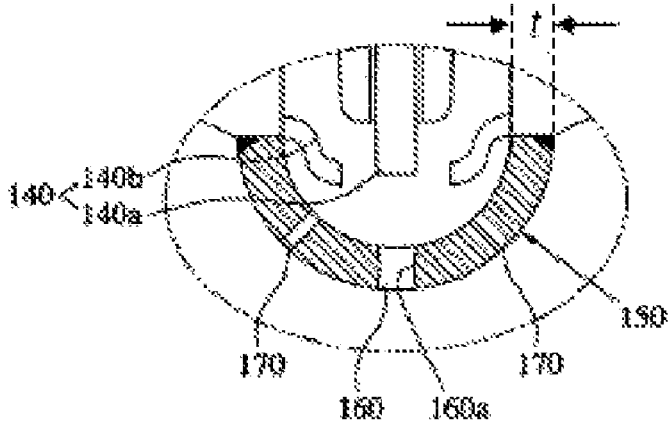
FIGS. 5A, 5B and 5C are laterally cross-sectional views showing various patterns of a pre-combustion chamber cell according to the present invention, respectively.
Figure 5B:
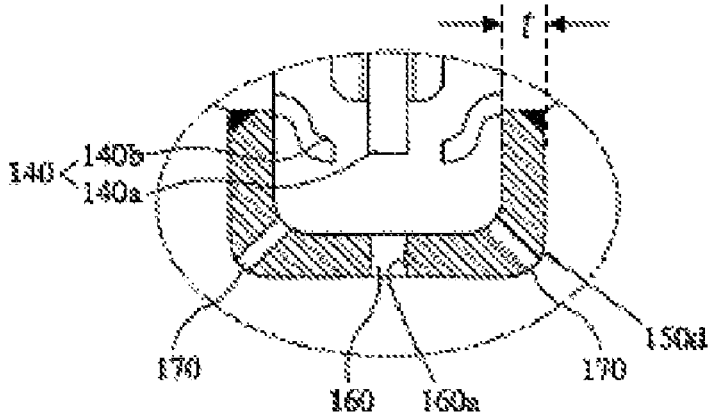
Figure 5C:
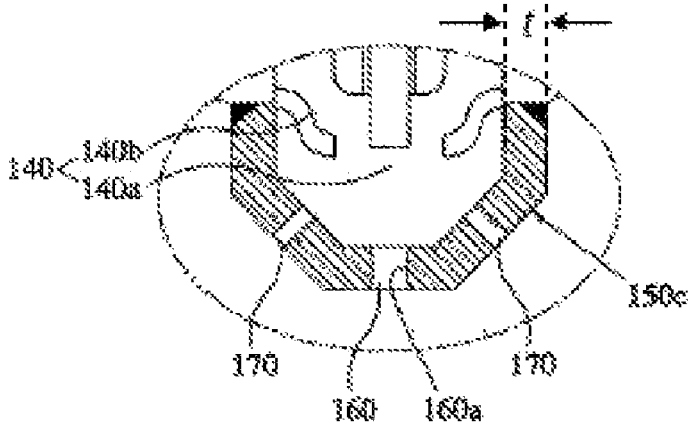

As shown in FIG. 3, a circumferential section 160*a* shown in FIGS. 5A to 5C in the main exhaust nozzle 160 is rounded to form a relatively smooth curve so that the fluid or gas of the fuel-air mixture or flames can smoothly go in and out of the pre-combustion chamber 151 along the smooth curved surface. Accordingly, the small-scale explosive flames generated in the pre-combustion chamber 151 pass through the main exhaust nozzle 160 and the auxiliary exhaust nozzles 170, and then are widely spread in the planar radial direction on the outer surface of the pre-combustion chamber cell 150 so as to be sprayed into the combustion chamber. As a result, the fuel-air mixture in the combustion chamber is ignited quickly and reliably to thereby increases a combustion speed.

The pre-combustion chamber cell 150 has a structure that is assembled in the lower portion of the main cell 110 to surround the electrodes 140 with an independent cap.

Meanwhile, FIGS. 4A, 4B, 4C and 4D show various embodiments of an exhaust nozzle in a pre-combustion chamber cell 150, respectively, in the ignition plug for an internal combustion engine according to the present invention.

Figure 4A:
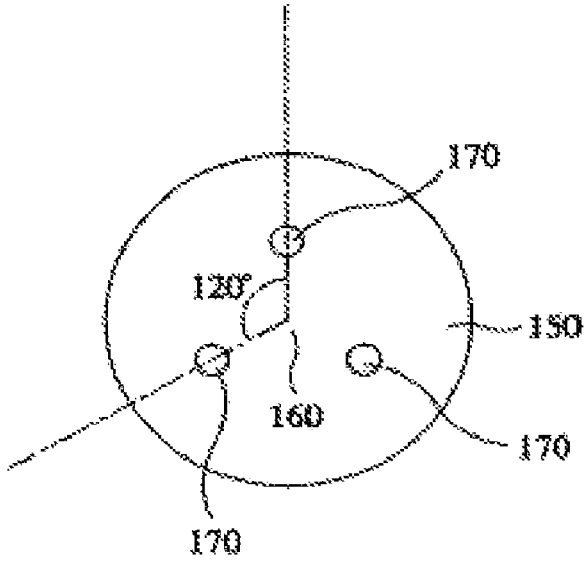
FIGS. 4A, 4B, 4C and 4D are enlarged bottom views showing various embodiments of an exhaust nozzle in a pre-combustion chamber cell of FIG. 3, respectively.

In FIG. 4A, the pre-combustion chamber cell 150, has three auxiliary exhaust nozzles 170 disposed with an interval of 120° around the origin of the pre-combustion chamber cell 150, without having a main exhaust nozzle 160.

Figure 4B:
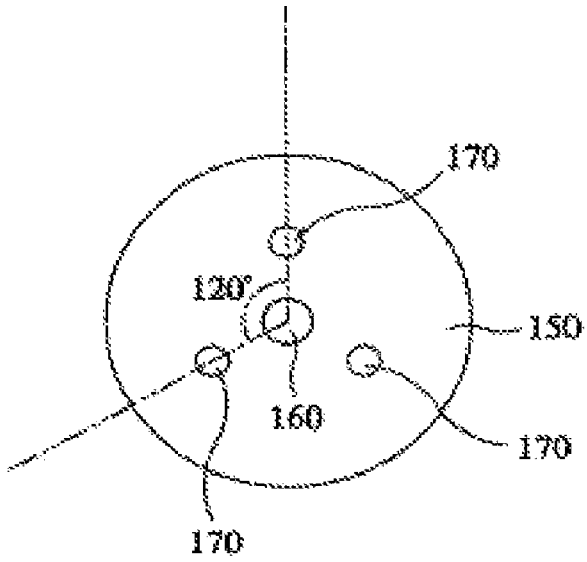

In FIG. 4B, the pre-combustion chamber cell 150 has four exhaust nozzles in which a main exhaust nozzle 160 is disposed on the central portion of the pre-combustion chamber cell 150 and three auxiliary exhaust nozzles 170 are disposed with an interval of 120° around the main exhaust nozzle 160.

Figure 4C:
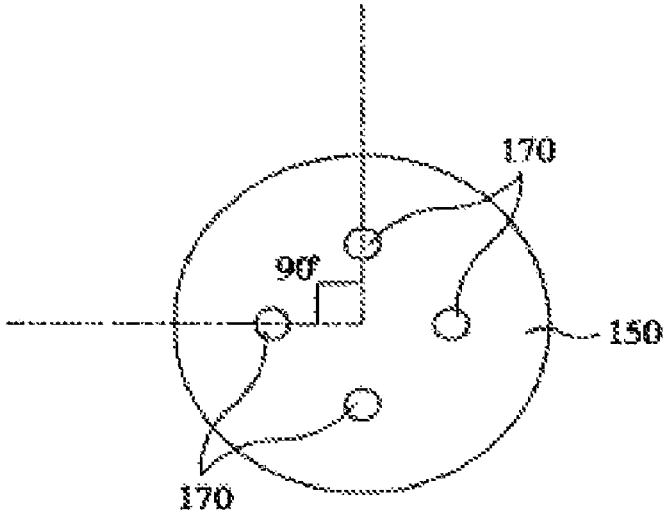

In FIG. 4C, the pre-combustion chamber cell 150 has three exhaust nozzles 170 disposed with an interval of 90° around the origin of the pre-combustion chamber cell 150, without having a main exhaust nozzle 160.

Figure 4D:
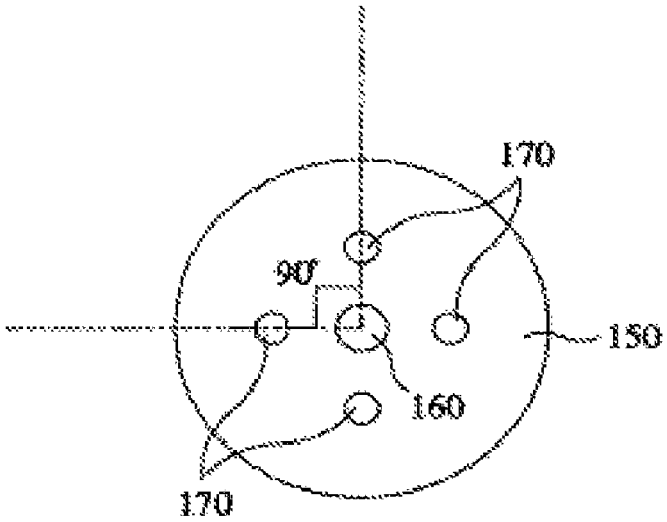

In FIG. 4D, the pre-combustion chamber cell 150 has five exhaust nozzles in which a main exhaust nozzle 160 is disposed on the central portion of the pre-combustion chamber cell 150 and four auxiliary exhaust nozzles 170 are disposed with an interval of 90° around the main exhaust nozzle 160.

The main exhaust nozzle 160 and the auxiliarly exhaust nozzles 170 are designed considering the space area of the pre-combustion chamber in which the alignment structure and size of the exhaust nozzles are varied according to an engine class such as SOHC and DOHC.

That is, in the case that a main exhaust nozzle does not exist in the SOHC engine shown in FIGS. 6A and 4A, it is preferable that three exhaust nozzles are formed in which each auxiliary exhaust nozzle is of 1.4Φ to 1.5Φ in diameter and is disposed distant by an interval of 120° from the adjacent auxiliary exhaust nozzle.

In the case that a main exhaust nozzle exists in the SOHC engine, it is preferable that the main exhaust nozzle is of 1.2Φ to 1.4Φ in diameter, and three auxiliary exhaust nozzles are of 1.0Φ to 1.2Φ in diameter, respectively and are disposed with an interval of 120° at the outer side of the main exhaust nozzle 160.

In the case that a main exhaust nozzle exists in the DOHC engine shown in FIGS. 6B and 4B, the, main exhaust nozzle 160 is widened as 1.2Φ to 1.4Φ in diameter, and thus it is preferable that three auxiliary exhaust nozzles 170 are of 1.0Φ to 1.2Φ in diameter, respectively and are disposed with an interval of 120° at the outer side of the main exhaust nozzle 160.

In the case that only auxiliary exhaust nozzles are installed without having a main exhaust nozzle, even in the DOHC engine as shown in FIG. 4C, it is preferable that each auxiliary exhaust nozzle is of 1.0Φ to 2.0Φ in diameter and is disposed distant by an interval of 90° from the adjacent auxiliary exhaust nozzle.

In the case that a main exhaust nozzle 160 is of 1.2Φ to 1.4Φ in diameter even in the DOHC engine as shown in FIG. 4D, it is preferable that four auxiliary exhaust nozzles 170 are of 1Φ to 1.4Φ in diameter, respectively, and are disposed with an interval of 90° around the main exhaust nozzle 160.

The auxiliary exhaust nozzles 170 together with the main exhaust nozzle 160 enable the flames of the fuel-air mixture to spread more widely toward the outer side of the pre-combustion chamber cell 150 to thereby smoothly go in and out of from the pre-combustion chamber 151 to the combustion chamber, and to be discharged into the combustion chamber to thereby ignite and burn the fuel-air mixture more quickly and reliably.

As a result, the fuel-air mixture is inhaled at an intake stroke, and compressed at a compression stroke, and simultaneously part of the fuel-air mixture raised by the piston 12 as shown in FIG. 1A is accommodated in the pre-combustion chamber 151.

Then, when a combustion stroke reaches an igniting point in time, the electrodes 140 is electrified to thus generate an electrical spark. This electrical spark ignites and burns the fuel-air mixture accommodated in the pre-combustion chamber 151. When the fuel-air mixture in the pre-combustion chamber 151 is burnt, the small-scale explosive flames are gene rated and filled in the pre-combustion chamber 151. The pressure of the explosive flames in the pre-combustion chamber 151 is increased by the ascending piston 12 up to a considerable height within an extremely short time.

At a point in time when the pressure of the pre-combustion chamber 151 is higher than that of the combustion chamber, the small-scale explosive flames in the pre-combustion chamber 151 are discharged toward the combustion chamber through the main exhaust nozzle 160 and the auxiliarly exhaust nozzles 170. In this case, since the auxiliarly exhaust nozzles 170 are additionally formed in comparison with the conventional art, the explosive flames are spread quickly and uniformly at an angle of 80° to 100° toward the outer side of the pre-combustion chamber cell 150, to then ignite and burn the fuel-air mixture compressed in the combustion chamber.

As a result, the fuel-air mixture in the combustion chamber is ignited by the explosive flames in the pre-combustion chamber 151, more quickly and reliably than in the conventional ignition plug, and burnt out within a much shorter time than the existing ignition plug.

As described above, since the ignition plug according to the present invention enables a combustion speed to be quick, a more reliable improvement of a combustion performance can be obtained, a fuel-to-air ratio can be enhanced, and an exhaust gas reduction effect can be also obtained at the engine, since the whole engine is ignited in retard and short at an angle from 5° to 15° or so, on a crankshaft, at a low speed. Also, noxious gas such as carbon monooxide (CO) and hydrocarbon (HC) can be reduced to accordingly enhance engine efficiency.

FIGS. 5A, 5B and 5C show various patterns of a pre-combustion chamber cell according to the present invention, respectively. That is, the pre-combustion chamber cell in the internal combustion engine according to the present invention can be made of one of various shapes such as a hemisphere, rectangle, U-shape, and trapezoid.

In the above-described embodiments, the pre-combustion chamber cell 150 has been described with a hemispherical shape. However, as shown in FIGS. 5A through 5C, the shape of the pre-combustion chamber cell 150*a*, 150*b*, or 150*c* can be made of a rectangle, U-shape, or trapezoid. In all the cases, the auxiliarly exhaust nozzles 170 are formed in the pre-combustion chamber cell 150*a*, 150*b* or 150*c*, to accordingly obtain the above-described excellent result.

As described above, when various shapes of exhaust nozzles are formed in number of at least three or more, the combustion speed of the whole engine becomes fast. Thus, a more reliable improvement of a combustion performance can be obtained, a fuel-to-air ratio can be enhanced by enhancing an engine efficiency and a combustion efficiency, since the whole engine is ignited in retard and short at an angle from 5° to 15° or so, on a crankshaft, at a low speed.

Also, noxious gas such as carbon monooxide (CO) and hydrocarbon (HC) can be reduced to accordingly enhance an overall engine efficiency.

The diameter and number of the main exhaust nozzle and the auxiliarly exhaust nozzles according to the present invention are designed considering the inner combustion chamber area of the pre-combustion chamber cell as well as difference between engine classes such as SOHC and DOHC.

For reference, the ignition plug according to the present invention has been tested for particular vehicles which be described below.

EXPERIMENT 1

Vehicle class: EF SONATA, 2000CC, DOHC engine
RPM-1800, 2.0 Bar BMEP. Torque 3.24 kgf/m
AIR-FUEL Ratio: (AFR) 14.5:1 (λ=1)
Igniting point in time: minimum angular igniting point in time for maximum torque,(MBT Timing)

TABLE 1 for Experiment 1.

Figure 1B:
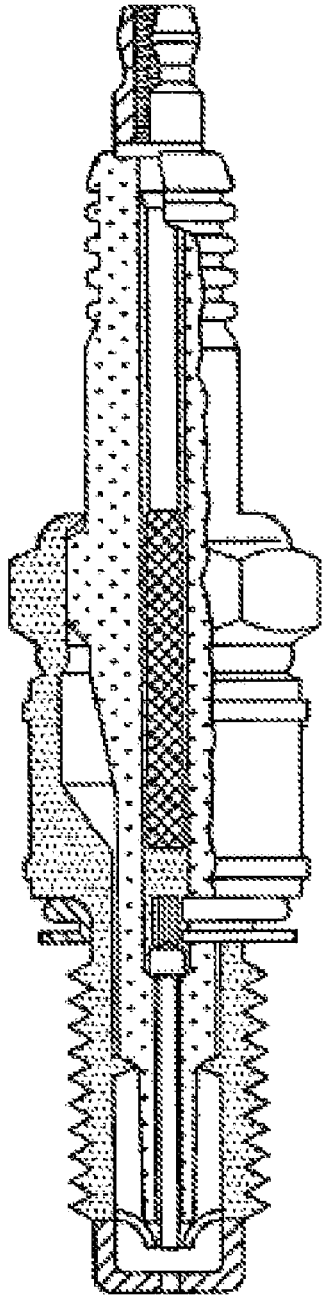
FIG. 1B Prior Art
FIG. 1B is a front view of an ignition plug disclosed in Korean Patent No. 328490 to the same assignee as that of the present application.

| Igniting class | Fuel injection time (msec) | Igniting time (crankshaft angular TDC (BTDC) | Measuring value of engine exhaust gas: Hydrocarbon (PPM) | Carbon monooxide (CO %) | Existing oxygen ($O_2$ %) | Map (kpa) |
|---|---|---|---|---|---|---|
| Existing ignition plug of FIG. 1B | 3.6 | 28 | 151 | 0.54 | 0.51 | 45 |
| Ignition plug (1) of present invention | 3.5 | 23 | 126 | 0.34 | 0.47 | 44.5 |
| Ignition plug (2) of present invention | 3.5 | 21 | 138 | 0.34 | 0.49 | 44.5 |

Referring to Table 1, when the ignition plug having a pre-combustion chamber according to the present invention has been used, it can be seen that a very stable engine state can be maintained. In the case of the ignition plug (1) of the present invention, the MBT timing (BTDC) is in retard by 5° in comparison with the existing certificated ignition plug, to thereby enable a combustion speed to become fast. The ignition plug (2) of the present invention is also in retard by 7° to accordingly make a combustion speed fast.

EXPERIMENT 2

Vehicle class: EF SONATA, 2000CC, DOHC engine
RPM-2400, 2.5 Bar BMEP. Torque 4.06 kgf/m
AIR-FUEL Ratio: (AFR) 14.5:1 (λ=1)
Igniting point in time: minimum angular igniting point in time for maximum torque (MBT Timing)

TABLE 2 for Experiment 2.

| Igniting class | Fuel injection time (msec) | Igniting time (crankshaft angular TDC (BTDC) | Measuring value of engine exhaust gas: Hydrocarbon (PPM) | Carbon monooxide (CO %) | Existing oxygen ($O_2$ %) | Map (kpa) |
|---|---|---|---|---|---|---|
| Existing ignition plug of FIG. 1B | 4.1 | 35 | 110.5 | 0.54 | 0.51 | 52 |
| Ignition plug (3) of present invention | 4.1 | 26 | 103.5 | 0.44 | 0.49 | 52 |
| Ignition plug (4) of present invention | 4.1 | 35 | 108 | 0.53 | 0.52 | 52 |

Referring to Table 2, when the ignition plug having a pre-combustion chamber according to the present invention has been used, it can be seen that a very stable engine state can be maintained. The ignition plug (4) of the present invention does not represent a combustion enhancement effect since the flames in the lower portion of the main cell of the ignition plug are 1.2 mmΦ in diameter, respectively which is the smallest.

However, in the case of the ignition plug (3) of the present invention, the MBT timing (BTDC) is in retard by 9° in comparison with the existing certificated ignition plug, to thereby enable a combustion speed to become the fastest.

INDUSTRIAL APPLICABILITY

As described above, the ignition plug according to the present invention enables the whole engine to have a quick combustion speed, with a result that a more reliable improvement of a combustion performance can be obtained, a combustion efficiency can be enhanced to thereby obtain a improvement of a fuel-to-air ratio, although the whole engine is ignited in retard and short at an angle from 5° to 15° or so, on a crankshaft, from at a low speed up to a high speed.

Also, the present invention brings about a noxious gas reduction effect of reducing noxious gas such as carbon monooxide (CO) and hydrocarbon (HC), to thereby enhance an overall engine efficiency. Also, a reduction effect of reducing a predetermined amount of carbon dioxide ($CO_2$) can be obtained through a fuel supply reduction according to a rare fuel-to-air ratio composition, to resultantly contribute greatly to reduction and suppression of inducing air pollution.

The present invention is not limited in the above-described embodiments. It is apparent to one who is skilled in the art that there are many variations and modifications without departing off the spirit of the present invention and the scope of the appended claims.

The invention claimed is:

1. An ignition plug for an internal combustion engine, the ignition plug comprising:

a hollow main cell;

a central electrode extending downward at a central portion of the main cell;

a pair of ground electrodes disposed adjacent to a tip of the central electrode and having an arc form; and a pre-combustion chamber cell coupled to the main cell to cover the pair of ground electrodes, thereby forming a pre-combustion chamber, wherein the ground electrodes are fixed to a wall of the main cell, and tips of the ground electrodes and the central electrode are located below a boundary surface of the main cell and the pre-combustion cell, wherein the pre-combustion chamber cell has a main exhaust nozzle facing the tip of the central electrode and four auxiliary exhaust nozzles surrounding the main exhaust nozzle, and wherein the ground electrodes extend downward from the main cell toward the pre-combustion cell and point to the tip of the central electrode, thereby forming an S-shape, wherein the four auxiliary exhaust nozzles are arranged with an angular interval of about 90 degrees around the main exhaust nozzle, and each of the four auxiliary exhaust nozzles has a diameter of about 1.0 Φ to about 1.4 Φ, when the main exhaust nozzle has a diameter of about 1.2 Φ to about 1.4 Φ, wherein the pre-combustion chamber cell has a diameter of about 14 mm to about 18 mm, and a height of about 6 mm to about 7 mm.

2. The ignition plug of claim 1, wherein the pre-combustion chamber cell has a thickness of about 0.5 mm to about 1 mm.

3. The ignition plug of claim 1, wherein the pre-combustion chamber cell has a shape of one of a hemisphere, a rectangle, a character U, and a trapezoid.

4. The ignition plug of claim 1, wherein the circumferential section of the main exhaust nozzle is rounded to form a smooth curve.

5. The ignition plug of claim 4, wherein the circumferential section of the auxiliary exhaust nozzle is straight.

6. The ignition plug of claim 5, wherein tips of the pair of ground electrodes face each other, and each of the pair of ground electrodes has a rounded stepwise shape.

7. The ignition plug of claim 6, wherein the tip of the central electrode is disposed more inside than the tips of the pair of ground electrodes, and the pair of ground electrodes are disposed apart from a length direction of the central electrode.

8. The ignition plug of claim 1, wherein tips of the pair of ground electrodes face each other, and each of the pair of ground electrodes has a rounded stepwise shape.

9. The ignition plug of claim 8, wherein the tip of the central electrode is disposed more inside than the tips of the pair of ground electrodes, and the pair of ground electrodes are disposed apart from a length direction of the central electrode.

10. The ignition plug of claim 1, wherein the tip of the central electrode is disposed more inside than tips of the pair of ground electrodes, and the pair of ground electrodes are disposed apart from a length direction of the central electrode.

* * * * *